US011067268B1

(12) United States Patent
Johnston et al.

(10) Patent No.: US 11,067,268 B1
(45) Date of Patent: Jul. 20, 2021

(54) APPARATUSES, SYSTEMS, AND METHODS FOR PROVIDING A BATTERY POWERED NIGHTLIGHT WITHIN A LIGHTED MIRROR

(71) Applicant: ELECTRIC MIRROR, LLC, Everett, WA (US)

(72) Inventors: Jon Philip Johnston, Bothell, WA (US); Seth Axel Coady, Tacoma, WA (US); Templeton Briggs, III, Snohomish, WA (US)

(73) Assignee: ELECTRIC MIRROR, LLC, Everett, WA (US)

( * ) Notice: Subject to any disclaimer, the term of this patent is extended or adjusted under 35 U.S.C. 154(b) by 61 days.

(21) Appl. No.: 16/433,769

(22) Filed: Jun. 6, 2019

Related U.S. Application Data

(60) Provisional application No. 62/681,261, filed on Jun. 6, 2018.

(51) Int. Cl.
*F21V 33/00* (2006.01)
*F21S 9/02* (2006.01)
(Continued)

(52) U.S. Cl.
CPC ..... *F21V 33/004* (2013.01); *A47G 1/02* (2013.01); *F21S 9/02* (2013.01); *F21V 23/003* (2013.01);
(Continued)

(58) Field of Classification Search
CPC ..... F21V 33/004; F21V 33/0464; F21V 33/0471; F21V 33/003; F21V 23/0442;
(Continued)

(56) References Cited

U.S. PATENT DOCUMENTS

2007/0014105 A1* 1/2007 Noguchi ..... F21V 23/0442 362/183
2011/0007500 A1* 1/2011 Gustaveson ..... F21V 21/092 362/183

(Continued)

*Primary Examiner* — Joseph L Williams
*Assistant Examiner* — Jose M Diaz
(74) *Attorney, Agent, or Firm* — Peloquin, PLLC; Mark S. Peloquin, Esq.

(57) ABSTRACT

An apparatus to provide a source of light includes a lighted mirror. The lighted mirror is configured for installation within a building. A single electrical power circuit provides a source of electrical power to the lighted mirror from the building. The single electrical power circuit is either in an ON state or an OFF state. The lighted mirror includes a nightlight system. The nightlight system includes a battery. The battery is electrically connected to charge when the single electrical circuit is in the ON state. The nightlight system includes a first sensor. The first sensor is configured to receive electrical power from the battery and to measure a first value for a first parameter from an area proximate to the lighted mirror. The nightlight system includes a nightlight. The nightlight is electrically connected to receive electrical power from the battery. The nightlight system has an ON state and an OFF state and control logic. The control logic receives the first value and turns the nightlight to an ON state when the first value is above a first threshold, thereby providing a source of light from the nightlight. When the single electrical power circuit is in the ON state, electrical power is inhibited from the nightlight and the nightlight is in the OFF state.

31 Claims, 14 Drawing Sheets

(51) Int. Cl.

| | |
|---|---|
| ***F21V 23/04*** | (2006.01) |
| ***A47G 1/02*** | (2006.01) |
| ***F21V 23/00*** | (2015.01) |
| ***F21Y 115/10*** | (2016.01) |

(52) U.S. Cl.
CPC ..... *F21V 23/0464* (2013.01); *F21V 23/0471* (2013.01); *F21Y 2115/10* (2016.08)

(58) Field of Classification Search
CPC ... F21V 23/04; A47G 1/02; A47G 1/00; F21S 9/02; F21S 8/035; F21S 9/022; F21S 9/024; F21L 4/027; F21W 2131/302; H02B 1/306; H02B 1/308; H02B 1/40; A45D 42/08; A45D 42/10; A45D 33/008; F21Y 2115/10; B60J 3/04; B60J 3/0282
See application file for complete search history.

(56) References Cited

U.S. PATENT DOCUMENTS

| | | | | |
|---|---|---|---|---|
| 2018/0032227 | A1* | 2/2018 | Broxson | G06F 1/1605 |
| 2019/0087788 | A1* | 3/2019 | Murphy | A47K 13/105 |

* cited by examiner

APPARATUSES, SYSTEMS, AND METHODS FOR PROVIDING A BATTERY POWERED NIGHTLIGHT WITHIN A LIGHTED MIRROR

RELATED APPLICATIONS

This application claims priority from U.S. Provisional Patent application No. 62/681,261 entitled "Motion Detect Battery Powered Nighlight," filed on Jun. 6, 2018. U.S. provisional patent application No. 62/681,261 entitled "Motion Detect Battery Powered Nighlight," is hereby fully incorporated by reference.

BACKGROUND OF THE INVENTION

1. Field of the Invention

The invention relates generally to lighted mirrors and nightlights, and more specifically to apparatuses, systems, and methods for providing a battery-operated nightlight within a lighted mirror.

2. Art Background

Lighted mirrors are typically understood as mirrors that are manufactured in such a way as to allow a light source behind the mirror to shine through the mirror's surface. Such functionality is accomplished in several ways, such as by removing the mirrors backing with sandblasting, chemical etching, laser, or some other means. A typical lighted mirror is composed of a mirror, a chassis, and electrical components. The chassis is a metal structure that is suspended on a wall, houses electrical components, and supports the mirror. Lighted mirrors are popular in hotel, commercial, residential bathrooms, as well as in other applications. In a hotel, commercial, or residential bathrooms, a nightlight incorporated into a lighted mirror is a valuable addition, however, several problems exist, particularly in hotel bathrooms. First, because items plugged into a receptacle are exposed to theft, and second, because a nightlight plugged into a receptacle uses up valuable receptacle space. A nightlight incorporated into a lighted mirror requires a separate circuit and cabling to be added inside the wall, which makes including a nightlight in a lighted mirror a costly upgrade. All of this can present problems.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

In various embodiments, apparatuses, systems, and methods are described which teach incorporating a nightlight into a lighted mirror. Note that the lighted mirror is switched on and off from a switch that is external to the lighted mirror. No modification to the existing electrical power circuit that supplies electrical power to the lighted mirror is necessary for the nightlight to function. The nightlight does not require a separate electrical power circuit, or a separate electrical wall plug to work. Thus, no modification to a building that the lighted mirror is installed in is necessary to support the functions of the nightlight. Embodiments of the invention are utilized in lighted mirrors that are used in Hotels, Motels, conference centers, civic centers, residential buildings, etc.

Figure 1:
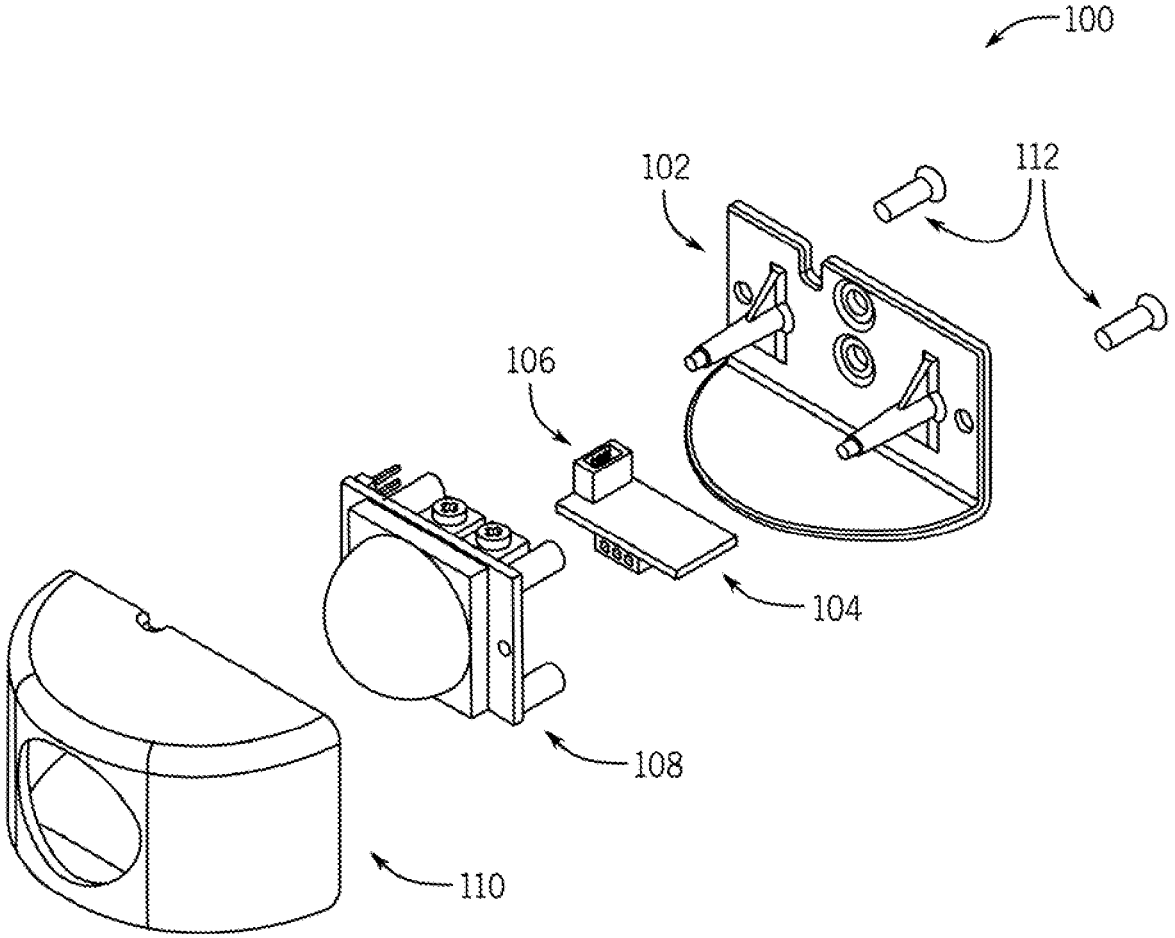
FIG. 1 illustrates an exploded perspective view of a nightlight and detection assembly, according to embodiments of the invention.

FIG. 1 illustrates, generally at 100, an exploded perspective view of a nightlight and detection assembly, according to embodiments of the invention. With reference to FIG. 1, a mounting bracket is illustrated at 102. The mounting bracket 102 is configured to receive a nightlight circuit board 104. The nightlight circuit board 104 receives a source of electrical power from a connector 106 attached thereto. A sensor unit 108 contains one or more sensors that are used to measure ambient data, such as light and motion in the vicinity of the lighted mirror. In various embodiments, the sensor unit 108 utilizes a photosensor to measure ambient light in the vicinity of the nightlight. A photosensor can be configured as a photoresistor, where the resistance of the device varies with exposure to light. An example provided merely for illustration, with no limitation implied thereby, is a photoresistor from Advanced Photonics, PDV-P8105.

The sensor unit 108 can also include a motion detector that is used to detect motion within a range of distances relative to the nightlight. In various embodiments, a passive infrared sensor (PIR) is used in the sensor unit 108 to detect motion. In some embodiments, a photosensor is combined together with a PIR sensor on the same circuit board. In one or more embodiments, an infrared sensor has an optional input for a resistor or variable resistor to prevent motion from activating the motion sensor's output. The photoresistor varies resistance with exposure to light, thus enabling or disabling the motion activation. In one or more embodiments, a photosensor's output at light levels above a threshold value disables the output of the motion sensor. Thus, in some embodiments, control logic for nightlight operation is realized through a sensor configuration that utilizes discrete analogue electrical components configured on a custom circuit board layout. In some embodiments, the control logic will be realized through a combination of a custom circuit board and one or more integrated circuits or integrate circuit devices and one or more analogue electrical components. Thus, the term "control logic" is to be given a broad flexible meaning within this description of embodiments, and is not to be limited to digital logic.

In other embodiments, an active infrared motion detector is used to detect motion. In yet other embodiments, motion is detected by utilizing different technology, such as, but not limited to, radar, acoustics, electromagnetic, etc. Signals obtained from the sensor unit 108 are used to determine when to turn the nightlight to a ON state and then back to an OFF state. Turning a nightlight to an ON state and to an OFF state are described below in conjunction with the figures that follow. The nightlight circuit board 104, the sensor unit 108, and the outer housing 110 are secured to the mounting bracket by fasteners such as screws 112. Note that screws 112 are an illustration of a device used to fasten components to the mounting bracket 102, no limitation is implied thereby. In various embodiments, other devices are used to fasten the components shown in FIG. 1, such as but not limited to, tape, interlocking joints, etc.

Figure 2:
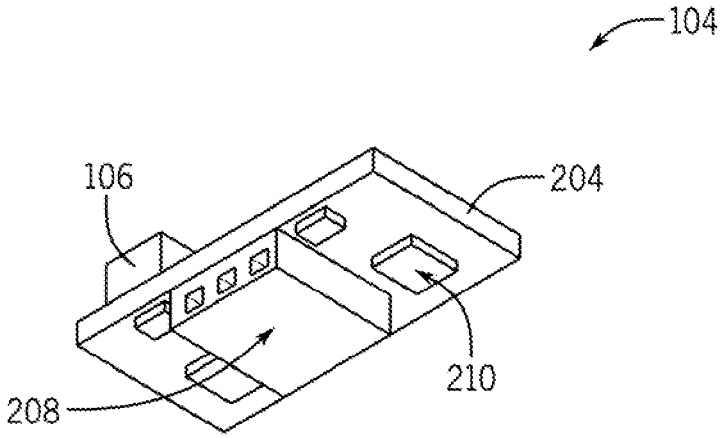
FIG. 2 illustrates a nightlight circuit board, according to embodiments of the invention.

FIG. 2 illustrates the nightlight circuit board 104 from FIG. 1, according to embodiments of the invention. With reference to FIG. 2, a nightlight circuit board 204 is shown from below in perspective view. The nightlight circuit board 204 has the power connector 106, a sensor connector 208, and a light source 210. The sensor connector 208 is used to connect the nightlight circuit board 204 to the sensor unit 108. In various embodiments, the light source 210 is a light source made with light emitting diode (LED) technology. In other embodiments, the light source is made with a different semiconductor technology, for example organic Light Emitting Diode (OLED), etc. In some embodiments, the light source is realized with an incandescent source of light and is made using a light bulb. Thus, a variety of different types of technology are used for a light source in different embodiments of the invention. Therefore, embodiments of the invention are not limited by to any specific type of light source.

The color temperature of the light source is selected to provide a warm color of light and can be selected to be in a vicinity of 2,200 Kelvin. Such a temperature vicinity provides an amber color that minimizes disruption of sleep and supports healthy circadian sleep cycles. Other light color temperatures are used in various embodiments, and the example of 2,200 Kelvin is given as an example without limitation.

Figure 3:
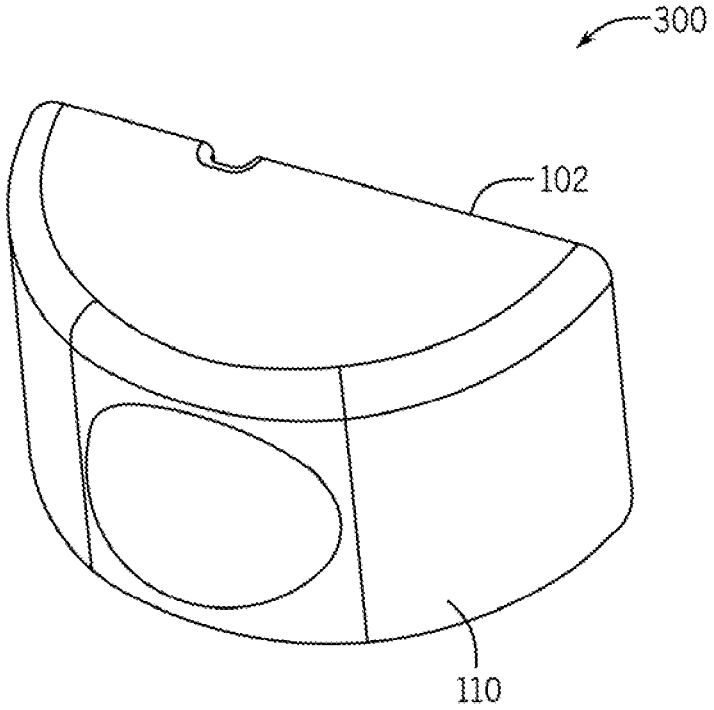
FIG. 3 illustrates an assembled view of a nightlight and detection assembly, according to embodiments of the invention.

FIG. 3 illustrates, generally at 300, an assembled view of a nightlight and detection assembly, according to embodiments of the invention. With reference to FIG. 3, the component parts illustrated in FIG. 1 and FIG. 2 are assembled together into a nightlight and detection assembly 300. Shown in FIG. 3 is the outer housing 110 and the mounting bracket 102. In various embodiments, the nightlight and detection assembly 300 is positioned on the lighted mirror. In some embodiments, the nightlight and detection assembly 300 is positioned just under the bottom edge of the mirror to maximize a field of view. Thereby permitting the nightlight and detection assembly 300 to detect motion and low ambient light conditions in a room. In some embodiments, a field of view for the nightlight and detection assembly 300 is on the order of 120 degrees. In other embodiments, a detection field of view is can be greater than 120 degrees or less than 120 degrees. In some embodiments, multiple motion sensors are used to increase a field of view over that which would be achieved from a single motion sensor. For example, in some embodiments, multiple motion sensors are used to provide a full 360-degree field of view relative to the mirror. Note that a mirror need not be mounted on a full-length wall that extends to a full dimension of a room. A wall can be a short wall just wide enough to accommodate a mirror. In such cases motion detection and nightlight functionality is realized that can provide detection of motion from a full 360-degree field of view. Sensors used to detect motion within a range of detection distances are described more fully below in the figures that follow.

With reference to FIG. 1 through FIG. 3 and as well, the figures to follow below, note that the nightlight circuit board 104 need not be part of the nightlight and detection assembly 300. These components can be separated and located as needed to different locations on the mirror.

Figure 4:
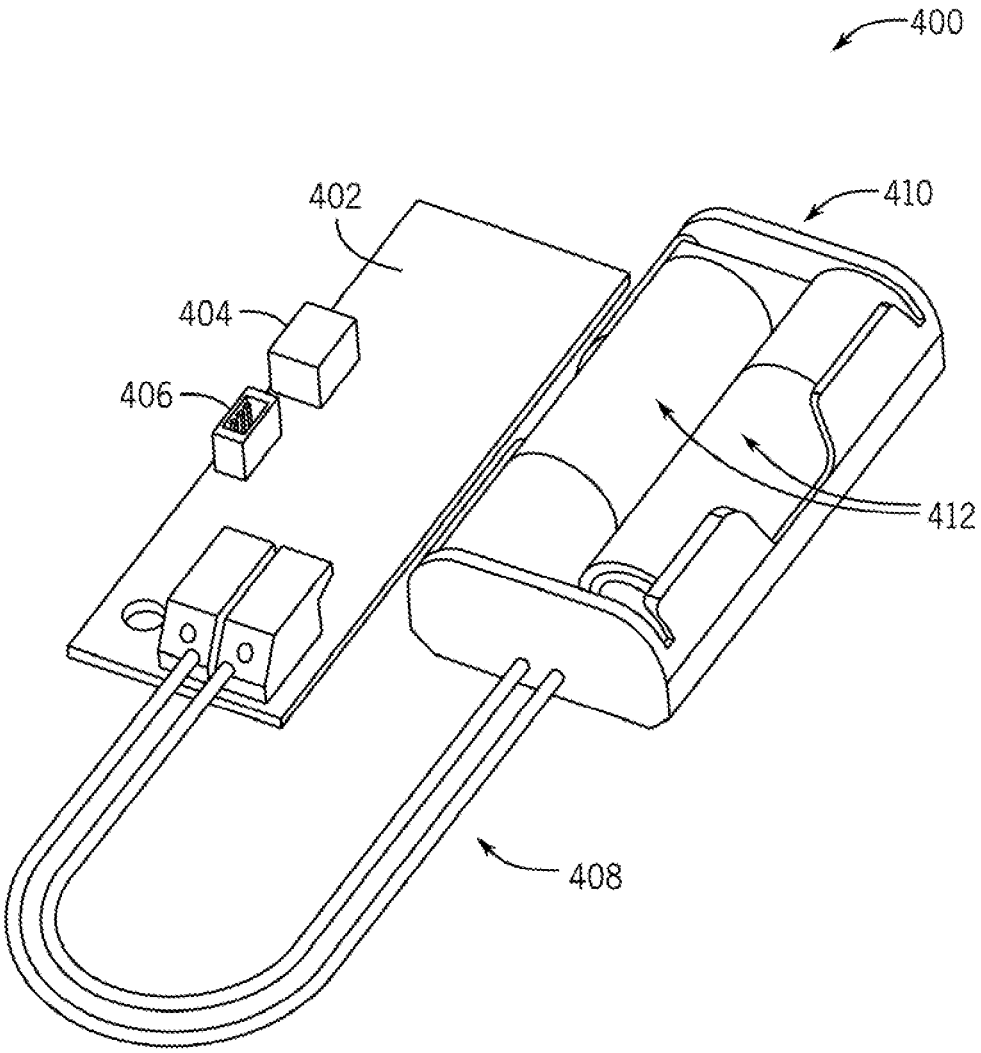
FIG. 4 illustrates a nightlight battery control system, according to embodiments of the invention.

FIG. 4 illustrates, generally at 400, a nightlight battery control system, according to embodiments of the invention. With reference to FIG. 4, a battery control circuit board is illustrated at 402. The battery control circuit board 402 has a connector 404 used to receive power from the lighted mirror as illustrated below in conjunction with FIG. 5. The battery control circuit board is electrically connected by a cable 408 to a battery pack 410 that holds one or more batteries 412. The battery control circuit board 402 also includes a battery charge controller (not shown but can be located on the underside of the battery control circuit board 402) that charges the battery 412 when power is present at the connector 404. The battery charge controller can be implemented in various ways in different embodiments. For example, in one or more embodiments, the battery is charged using a buck-boost converter with charging current regulated with specific resistor values. The circuit can also include overcurrent and/or overvoltage protection. In other embodiments, battery charging is performed using a charge controller provided as an integrated circuit.

Power is present at the connector 404 when the lighted mirror is powered up and placed in an ON state. Powering up a lighted mirror is ordinarily done from a switch mounted on a wall that is proximate to the mirror. In operation, a user operates a switch, such as a wall switch, thereby enabling power to the lighted mirror, which places the single source of electrical power to the lighted mirror in the ON state. When the user turns the wall switch off, the lighted mirror transitions to an OFF state. In the OFF state there is no electrical power available at the lighted mirror from the building power circuit.

The battery charge controller is configured to charge the battery 412 when the lighted mirror is in the ON state. When the lighted mirror is switched off, to the OFF state, battery charging ceases and resumes again the next time that the lighted mirror is switched to the ON state. In operation, electrical power from the battery 412 is available at the connector 406 and is provided to the nightlight and detection assembly 300 via the connector 106 (shown in FIG. 1 and FIG. 2).

In various embodiments, the battery control circuit board 402 is configured to direct power to more than just a nightlight in response to the lighted mirror being switched to an OFF state. For example, the battery control circuit board 402 can provide electrical power to a device that is included with the light mirror, such as, but not limited to, information illuminated through the mirror (e.g., time, weather, information, etc.), playing audio, etc.

In some embodiments, the battery 412 is replaced with an energy storage device other than a battery. In such cases, the battery control circuit board 402 is an energy storage device control circuit board that is adapted to the particular energy storage device used. One example, of an energy storage device other than a battery is a fuel cell.

Figure 5:
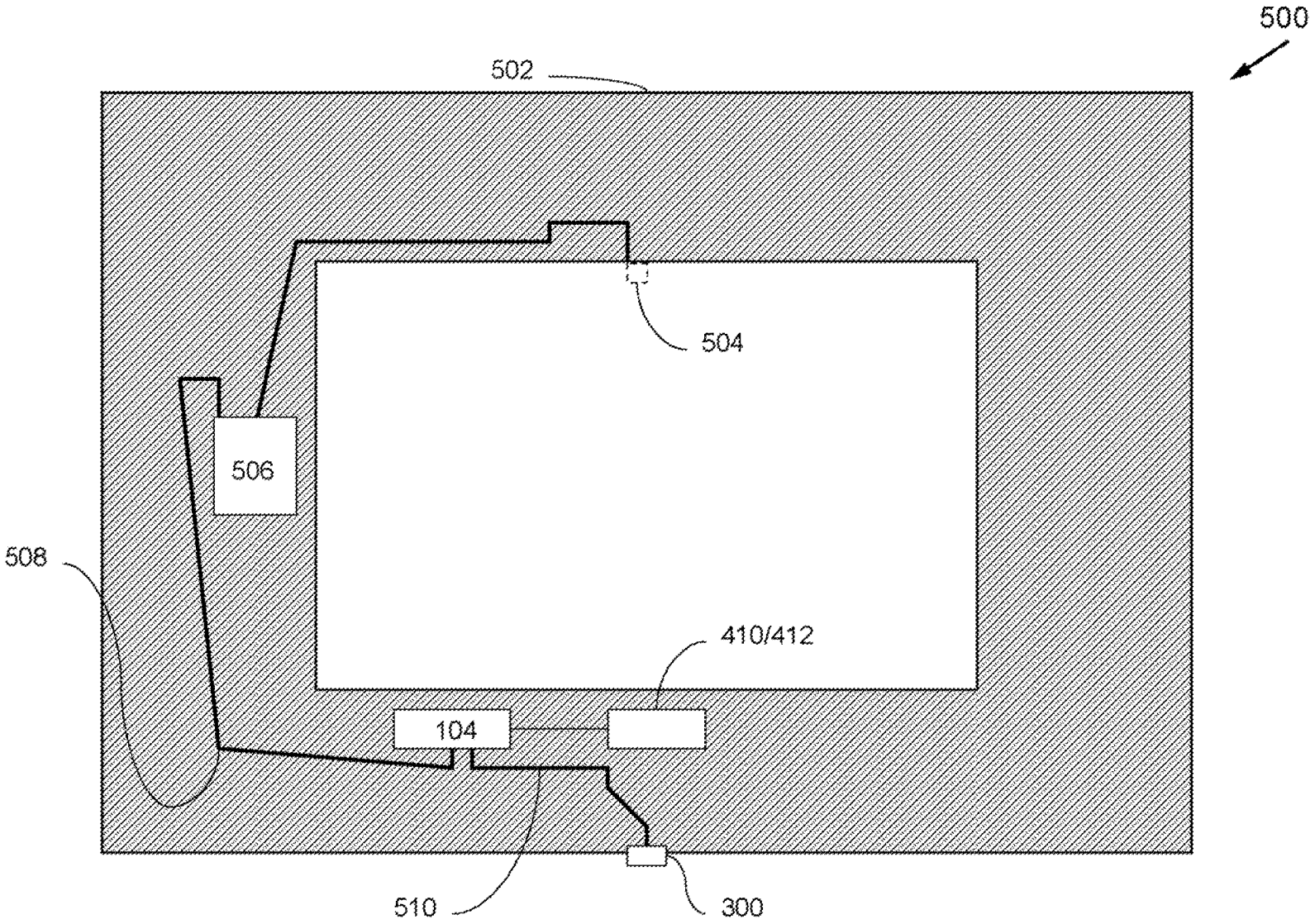
FIG. 5 a lighted mirror chassis with a nightlight system, according to embodiments of the invention.

FIG. 5 illustrates, generally at 500, a rear view of a lighted mirror with a nightlight system, according to embodiments of the invention. With reference to FIG. 5, a lighted mirror chassis 502 is illustrated in a rear view that shows the wiring and component layout according to various embodiments. As described above, the lighted mirror 500 receives a single source of electrical power from a building's power distribution infrastructure that runs through a wall, ceiling, floor, etc. of the building. A single electrical power circuit enters the lighted mirror at 504 from the building. Electrical power is supplied to buildings according to various standards such as 110-120 volts alternating current (AC) in the United States and 220-240 volts AC in other countries such as in, for example, European countries. The AC power is converted to DC at a point along the path from the building to the nightlight. The conversion can be performed with a power supply in an appropriately configured location external to the lighted mirror, or in a location within the lighted mirror.

In some embodiments, the conversion is done at a power distribution board 506 which can include a power supply that converts the input AC power input to a direct current (DC) output at one or more lower voltages. Alternatively, the conversion can be done at another location within the lighted mirror such as at the battery control circuit board 104 or elsewhere. Regardless of where the AC to DC conversion occurs when the mirror is in the ON state electrical power is provided at 508 to the battery control circuit board 104. Thereby, enabling the battery charge controller to charge the battery 412.

As described above, when the mirror is switched to the OFF state, battery charging ceases and nightlight mode can occur if certain logical conditions are ascertained by the logic embodied within the design and operating the system illustrated in the figures. For example, in some embodiments a microcontroller is used to process signals from the sensor unit 108, switching the nightlight to an ON state or OFF state and providing battery charging functionality. In other embodiments, hardwired circuitry is used to provide the necessary logic for the operation of the battery-operated nightlight system. For example, in one or more embodiments, the nightlight circuit board 104 is wired at 508 to receive voltage from the power distribution board 506 when the single electrical power circuit is in an ON state at 504. When the voltage from the power distribution board 506 is high (single electrical power circuit is ON), a transistor is used on the nightlight circuit board 104 to prevent the light source 210 from operating. Thus, the nightlight is inhibited from operation when the mirror is switched to the ON state. Other electrical circuits constructed with hardwired components are utilized in other embodiments to provide the logic needed for the operation of the battery powered nightlight functionality. The example given herein is provided merely for illustration and does not limit embodiments of the invention. Operation of the nightlight is described further below in conjunction with the figures that follow.

Figure 6:
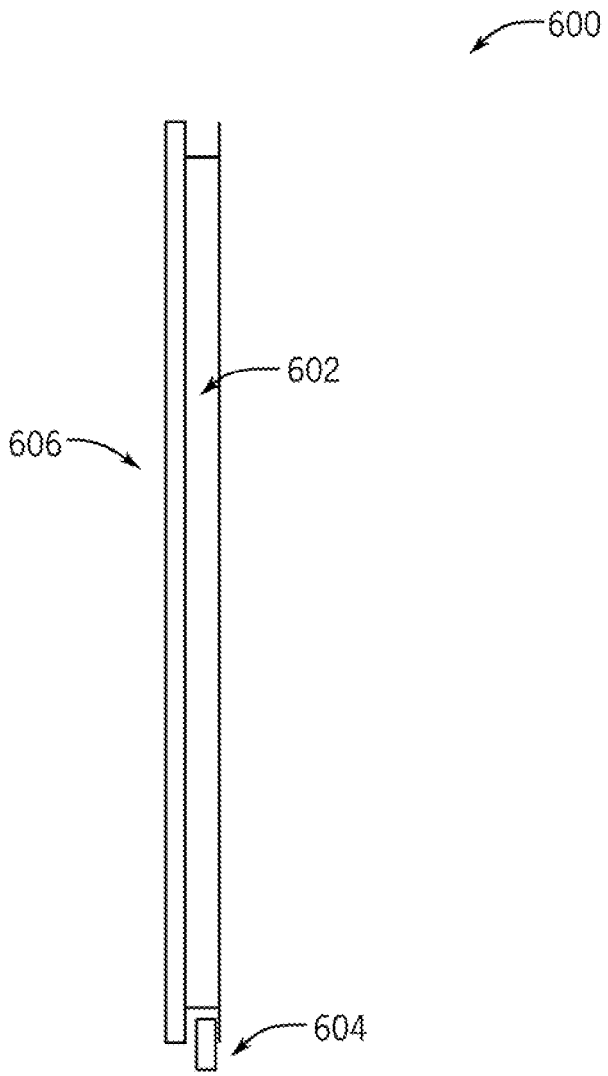
FIG. 6 illustrates a side view of a lighted mirror, according to embodiments of the invention.

FIG. 6 illustrates, generally at 600, a side view of a lighted mirror, according to embodiments of the invention. With reference to FIG. 6, a lighted mirror has a chassis 602. The chassis 602 is used to support a number of different components, such as, but not limited to, a mirror 606 and a nightlight and detection system 604.

Figure 7:
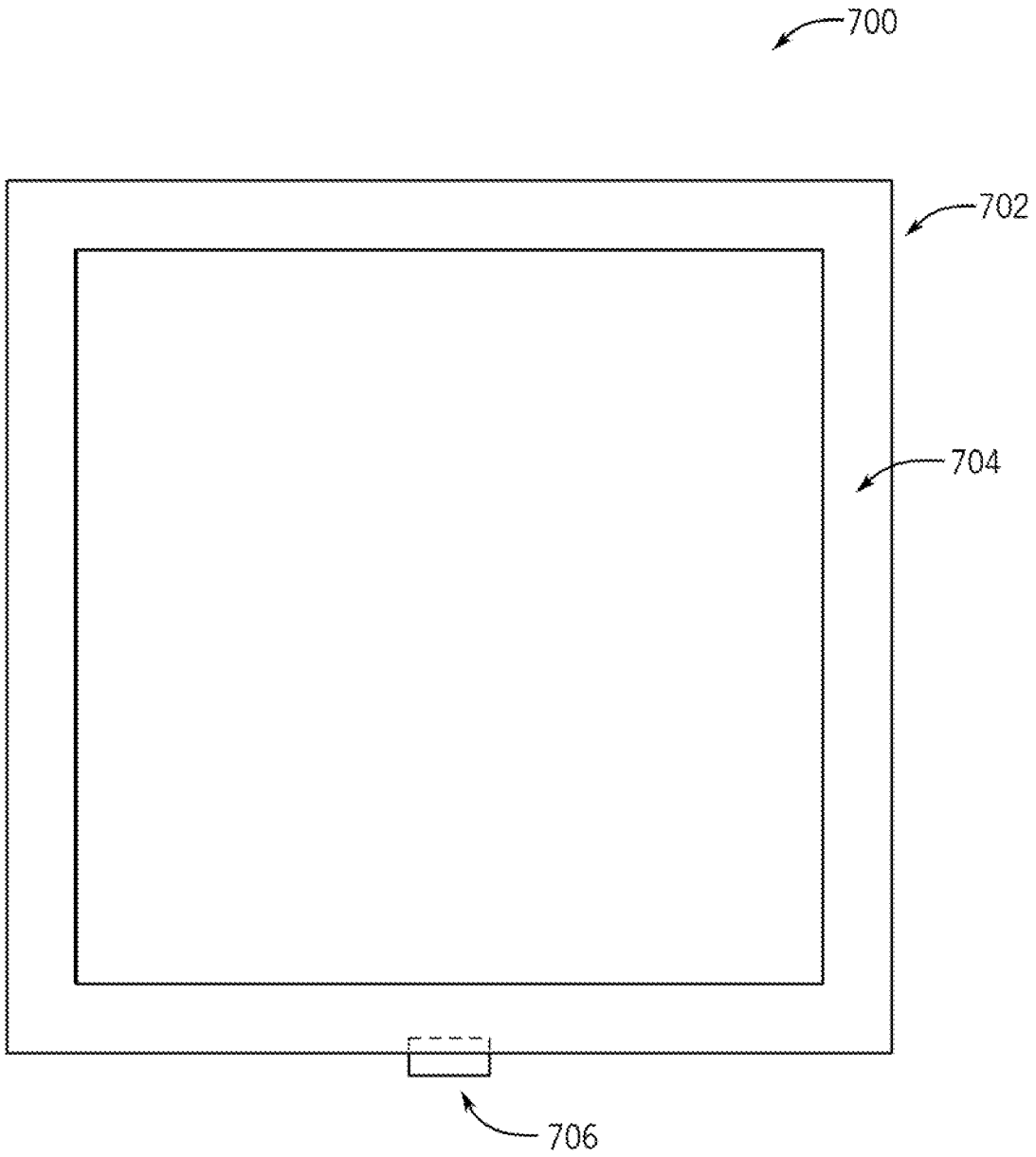
FIG. 7 illustrates a front view of a lighted mirror, according to embodiments of the invention.

FIG. 7 illustrates, generally at 700, a front view of a lighted mirror, according to embodiments of the invention. With reference to FIG. 7, a lighted mirror 702 is mounted to a wall. In one or more embodiments, the lighted mirror has a region 704 indicated around an outer perimeter of the mirror that is prepared to permit transmission of light therethrough. Such a treatment results in a backlit mirror with a frost pattern. In some mirror constructions, paint on a back side of a mirror has been removed and the front and/or back of the mirror has been processed for example, by sand blasting, or another treatment, to allow light generated on a back side of the mirror to shine from behind the mirror through to a front side. Thus, a user who views the front side of the lighted mirror is illuminated and can see his or her reflection more clearly. The lighted mirror 702 is illustrated with a nightlight and detection system 706 along a lower horizontal edge of the mirror. The nightlight and detection system 706 can be located in other positions on the lighted mirror and the location shown in FIG. 7 is provided merely for illustration with no limitation. The light radiating from the nightlight can be directed to any direction through suitable location of the light sources used to provide the nightlight. For example, the light from the nightlight can be directed, without limitation, in an upward direction, out to one side or both sides or an entre perimeter the lighted mirror can be configured with nightlight light elements.

In some embodiments, the nightlight and detection system 706 is not visible from the front side of the lighted mirror 702. Other patterns and locations of the back-light area 704 are provided in other embodiments. The perimeter region shown in FIG. 7 for 704 is shown merely for illustration and no limitation is implied thereby.

In some embodiments, the light radiating from the nightlight light source is located behind the mirror and the light shines through the mirror glass thereby illuminating a portion of the mirror surface for the nightlight illumination.

In some embodiments, the nightlight and detection system 706 is located fully behind a mirror and detects motion and low ambient lighting conditions by way of reflection.

Figure 8:
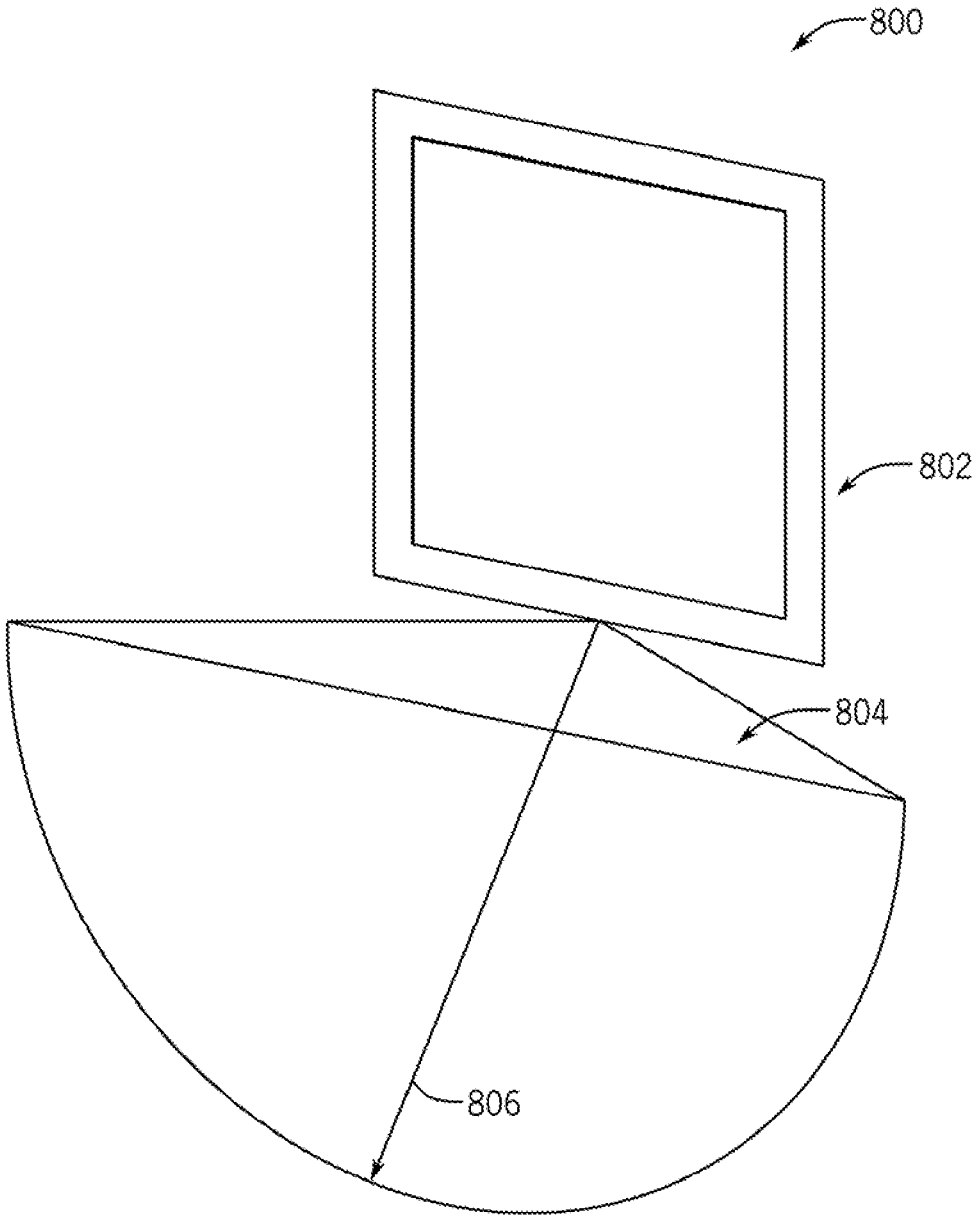
FIG. 8 illustrates a sensor detection zone, according to embodiments of the invention.

FIG. 8 illustrates, generally at 800, a sensor detection zone, according to embodiments of the invention. With reference to FIG. 8, a lighted mirror 802 is illustrated mounted in a generally vertical orientation on a wall of a room for example. A nightlight and detection system is located at a bottom edge of the lighted mirror 804. In one or more embodiments, a motion detector sensor is included in the nightlight and detection system. The motion detector has a detection zone indicated by 804 and 806. The detection zone extends both below the lower edge of the lighted mirror 802 and it extends a distance normal to the wall. Thus, a detection zone is indicated generally as a three-dimensional region projected in front, to the left, to the right, and below the lighted mirror. In some embodiments a motion detector is configured to place its detection region with an emphasis in a preferred direction. The detection range is sized for the room that the lighted mirror is used within, with some ranges being smaller than others.

Figure 9:
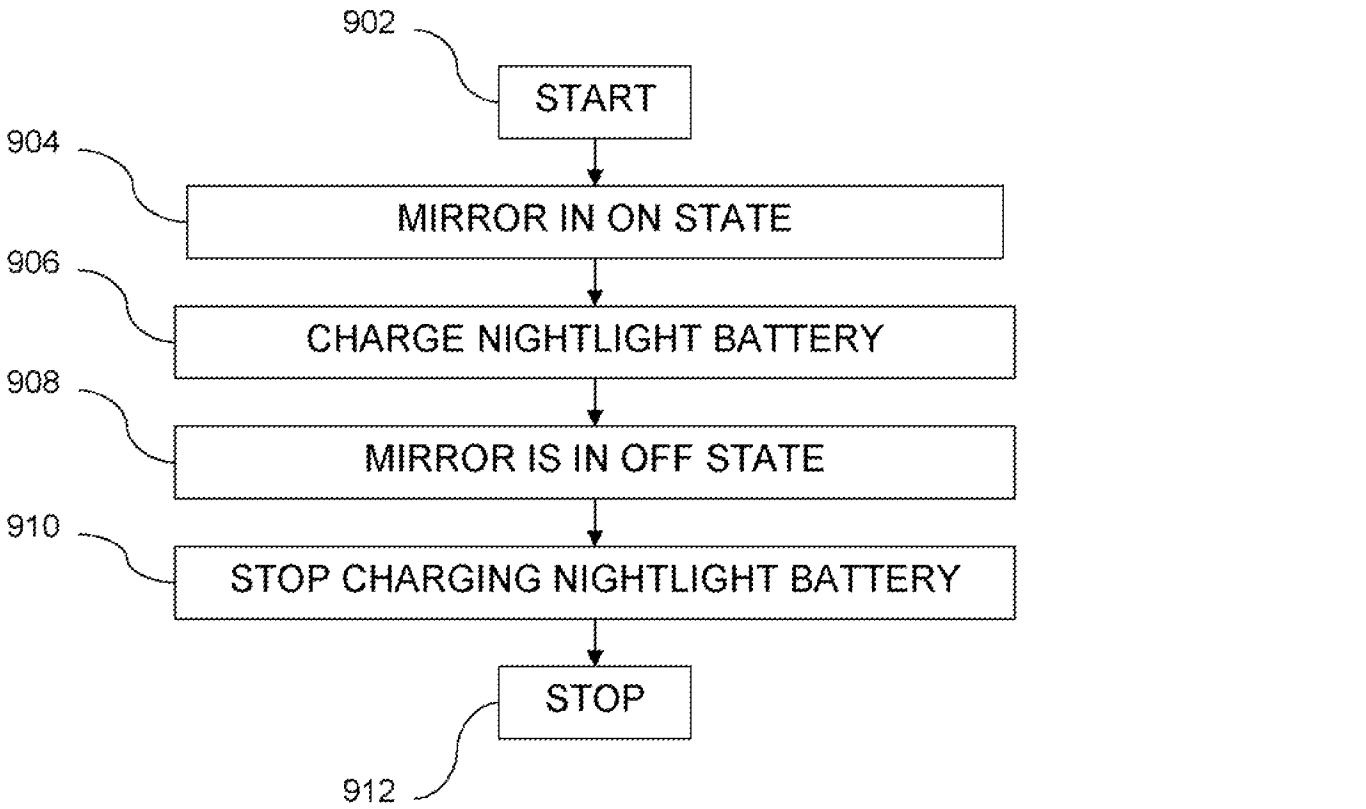
FIG. 9 illustrates a method of charging a nightlight battery, according to embodiments of the invention.

FIG. 9 illustrates, generally at 900, a method of charging a nightlight battery, according to embodiments of the invention. As described above, a lighted mirror that is connected to a single electrical power circuit is switched to an ON state and to an OFF state by a user operating a switch. The switch can be a wireless switch, a hardwired switch on a wall, etc. The single power circuit only provides a source of electrical power when the electrical circuit is switched to the ON state. When the single electrical circuit is switched to the ON state, the electrical power is used to charge a battery that is used to power a nightlight when the lighted mirror is switched to the OFF state. In various embodiments, the nightlight battery(s) are charged by various methods. With reference to FIG. 9, a method begins at a block 902. At a block 904, a lighted mirror is switched to an ON state. In an ON state, a lighted mirror's backlighting is powered up and a nightlight is not needed. At a block 906 a battery charge controller enters a charge mode where the electrical power supplied externally from the lighted mirror is used to charge the on-board battery. At a block 906 the battery charge controller charges the nightlight battery while the external source of electrical power is available. At a block 908 the lighted mirror is switched to an OFF state. In the OFF state, the external source of electrical power is no longer available for the battery charging system. At a block 910 battery charging stops. At a block 912 the method ends. If the lighted mirror is switched back to an ON state the battery charging commences again and remains until either the battery is fully charged or the lighted mirror is switched back to the OFF state. Following this method, the on-board nightlight battery is charged while the lighted mirror is in an ON state and is not charges when the lighted mirror is in the OFF state.

Figure 10:
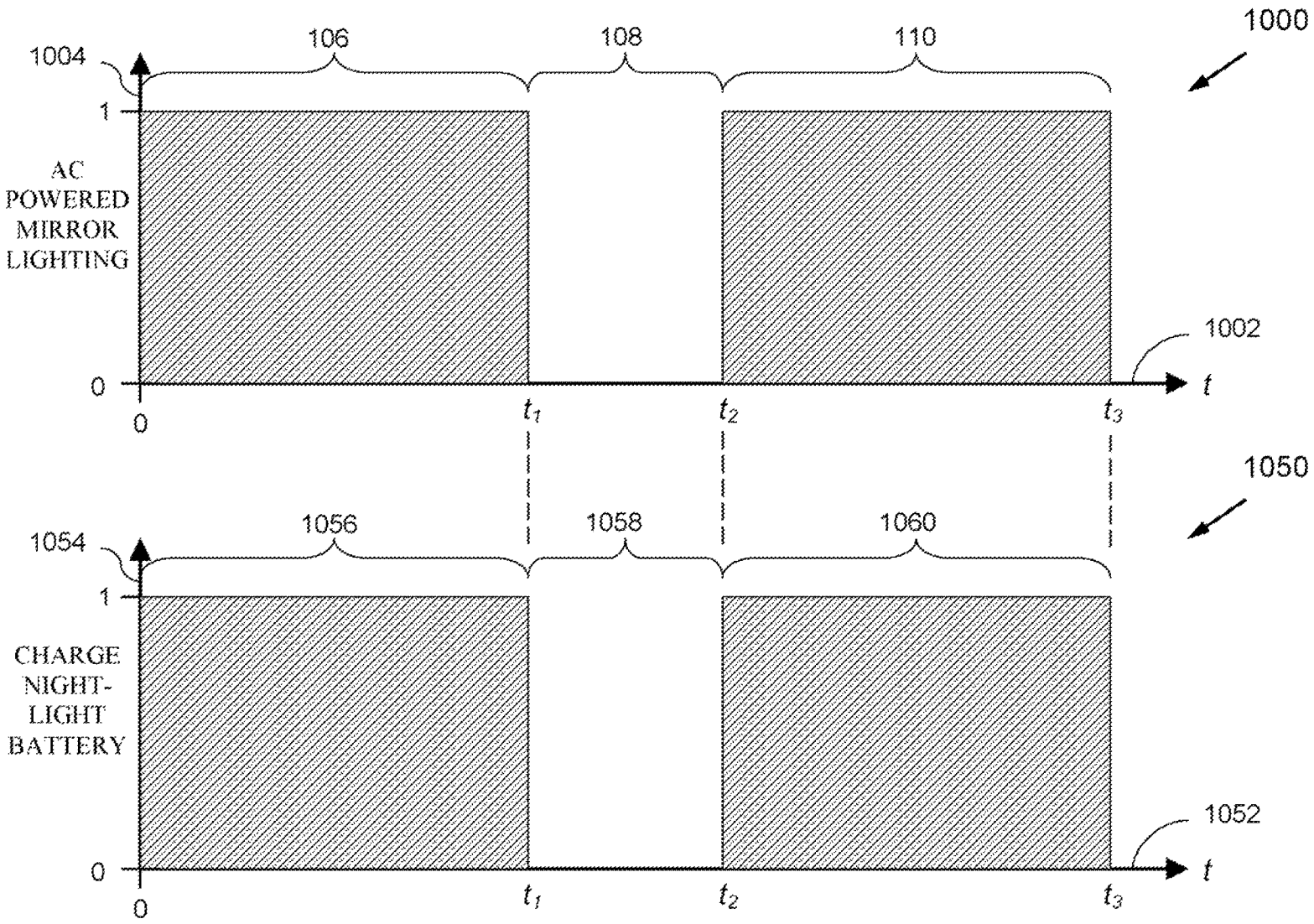
FIG. 10 illustrates a charging time profile according to the method of FIG. 9, according to embodiments of the invention.

FIG. 10 illustrate a charge state-time profile following the method of FIG. 9, according to embodiments of the invention. With reference to FIG. 10, a lighted mirror power profile is shown as a function of time. In 1000, time is plotted on a horizontal axis at 1002 and a lighted mirror power state is illustrated on the vertical axis at 1004, where 0 indicates the OFF state and 1 indicates the ON state. In operation, when a user turns the lighted mirror on for a period of time, indicated by $t_1$, mirror is in power state 1 for duration 106 (corresponding to elapsed time $t_1$).

Referring to 1050 in FIG. 10, time is plotted along a horizontal axis at 1052 and nightlight battery charging state is plotted on a vertical axis 1054 with 0 representing the charging system in an OFF state and 1 representing the charging system in an ON state. The battery is charging in the ON state. As described above for 1000, 106 represents a period of time when the lighted mirror is switched to the ON state. Note that in response thereto, the nightlight battery charging system is correspondingly switched to the ON state for the same period of time, as indicated at 1056.

At the time $t_1$, the user switches the lighted mirror to the OFF state. Note that the OFF state is indicated over a region 108. Correspondingly, the nightlight battery charging system is switch to the OFF state for a period indicated at 1058.

At the time $t_2$, the user switches the lighted mirror back to the ON state and the lighted mirror remains in the ON state until time $t_3$, this interval is indicated at 110. Correspondingly, the nightlight battery charging system is switched to the ON state for a period indicated by the interval at 1060. As described and depicted graphically in conjunction with FIG. 10, the nightlight battery charging system is switched on and off by the control system in response to the user switching the lighted mirror to the ON state and then switching the lighted mirror back to the OFF state. Three cycle are shown in FIG. 10, however in operation an unlimited number of cycles are set into motion over the life of the lighted mirror.

Various types and configurations of batteries can be used to supply a source of electrical power to the battery powered nightlight. Referring back to FIG. 4, two AA size batteries are illustrated in the figure at 412, however, no limitation is implied thereby. Other numbers and sizes of batteries are provided in various embodiments of the invention. In one embodiment, a low cost, long ON time solution is provided for a battery 412 by two Nickle Metal Hydride (NiMH) batteries.

Figure 11:
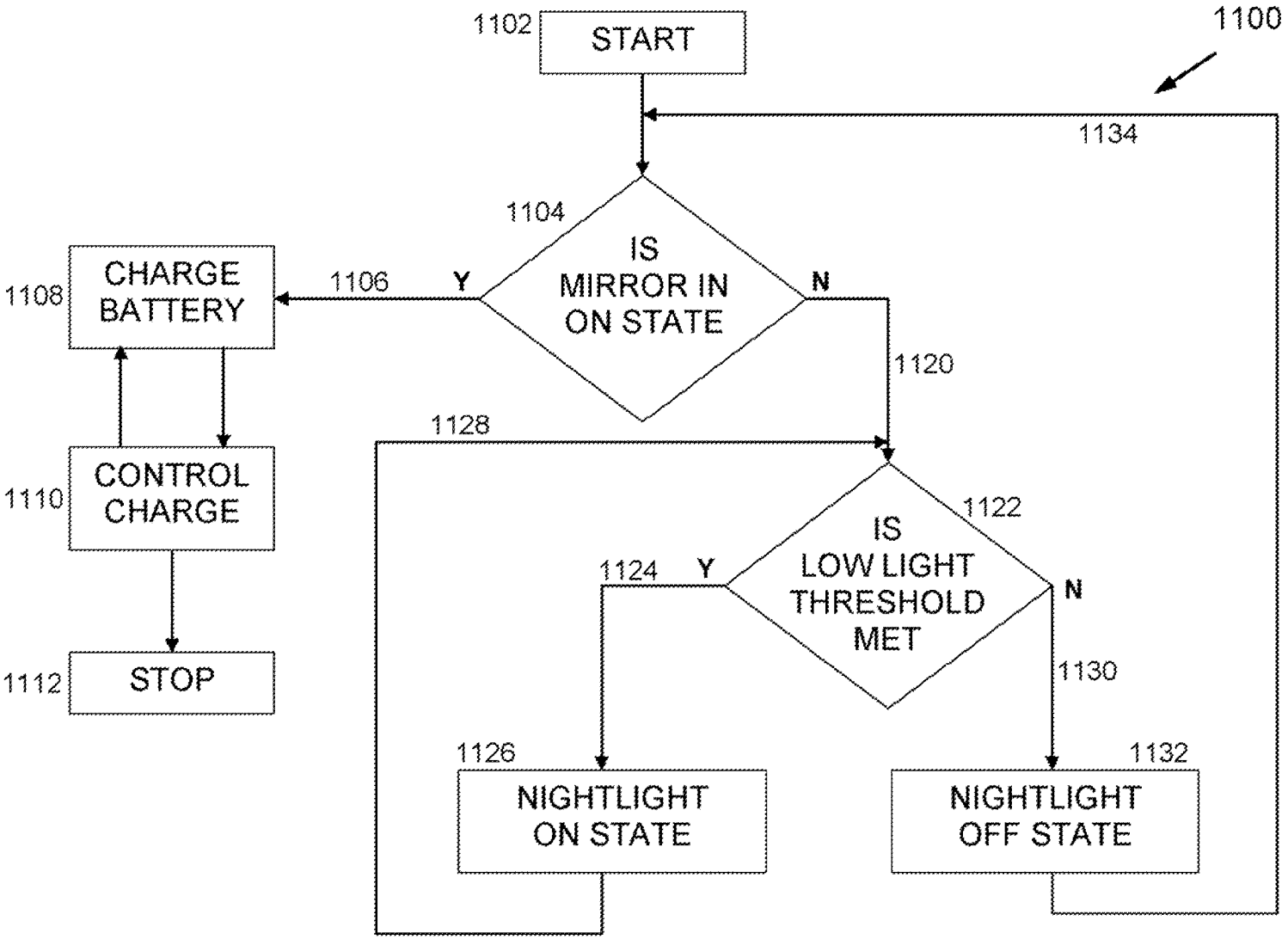
FIG. 11 illustrates a first method of operating a nightlight, according to embodiments of the invention.

The sensor unit FIG. 11 illustrates, generally at 1100, a first method of operating a nightlight, according to embodiments of the invention. With reference to FIG. 11, a method starts at a block 1102. At a block 1104, when a lighted mirror is turned to the ON state control transfers via branch 1106 and commences battery charging at a block 1108. Battery charging is controlled by a charge controller 1110. When the charging is finished the charging stops at a block 1112.

If the mirror is turned to the OFF state, then control transfers to a branch 1120 and to the block 1122. Control also transfers to the block 1122 even if charging is not completed in the situation where the user turned the lighted mirror to the OFF state. When the mirror is turned to the OFF state, the nightlight and detection system can power the nightlight when ambient light falls to a threshold value. At a block 1122 a photosensor measures ambient light level in the vicinity of the lighted mirror. When the measurement of ambient light falls to the threshold value, control transfers via 1124 to a block 1126 and the nightlight is turned to the ON state via battery power. Control cycles via 1128 back to the block 1122 where the ambient light level is checked against the threshold value. If the measurement of ambient light remains below the preset threshold value, then the light remains in the ON state.

At the block 1122, if the measurement of ambient light is not below the threshold value then control transfers at 1130 to the block 1132 and the nightlight is moved to the OFF state. The method can cycle in a loop 1134/1104/1122/1130/1132 until the measurement of light is below the threshold value or until the user switches the lighted mirror to the ON state which transitions the nightlight charging system to the charge state and commences charging the battery if required. In some embodiments, a switch is provided for the nightlight system that disables the system and conserves battery power when not in use.

Figure 12:
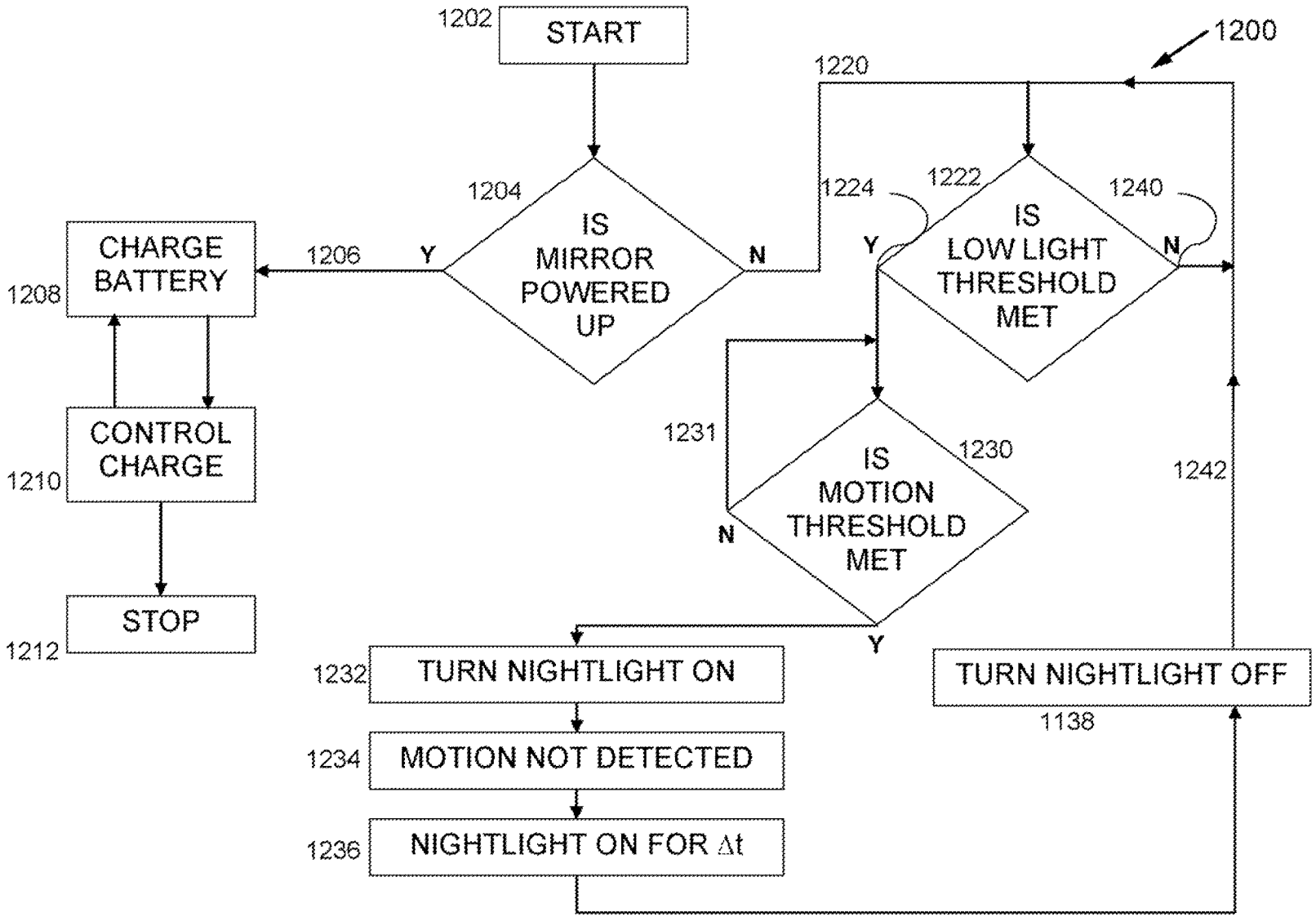
FIG. 12 illustrates a second method of operating a nightlight, according to embodiments of the invention.

FIG. 12 illustrates, generally at 1200, a second method of operating a nightlight, according to embodiments of the invention. With reference to FIG. 12, a method starts at a block 1202. At a block 1204, when a lighted mirror is turned to the ON state control transfers via branch 1206 and commences battery charging at a block 1208. Battery charging is controlled by a charge controller 1210. When the charging is finished the charging stops at a block 1212.

If the mirror is turned to the OFF state, then control transfers to a branch 1220 and to the block 1222. Control also transfers to the block 1222 even if charging is not completed in the situation where the user turned the lighted mirror to the OFF state. When the mirror is turned to the OFF state, the nightlight and detection system can power the nightlight when ambient light falls to a threshold value and motion is detected. At a block 1222 a photosensor measures ambient light level in the vicinity of the lighted mirror. When the measurement of ambient light falls to the threshold value, control transfers via 1224 to a block 1230. A motion sensor in the sensor unit can respond to motion within a detection range of the sensor. If motion is detected at the block 1230 control moves to the block 1232 and the nightlight is turned to the ON state via battery power. If motion is not detected at the block 1230 and the measurement of ambient light remains below the threshold, control cycles at 1231 until motion is detected or until the lighted mirror is turned to the ON state.

Following the start of the ON state for the nightlight, the nightlight remains in the ON state until motion is no longer detected. A block 1234 signals that motion is no longer detected. At the point where motion is no longer detected, the nightlight remains in the ON state for a preset length of time indicated as Δt 1236. After expiration of the preset length of time Δt, control transitions to 1238 and the nightlight is turned to the OFF state. Control transitions via 1242 back to 1222 where the previous steps are cycled through again, system logic evaluates the outputs of the photosensor and motion detector against their respective threshold values and turns the nightlight on when the output of the photodetector is below a threshold (ambient light is dim enough) and the output of the motion detector is above a threshold value (motion is detected).

Figure 13:
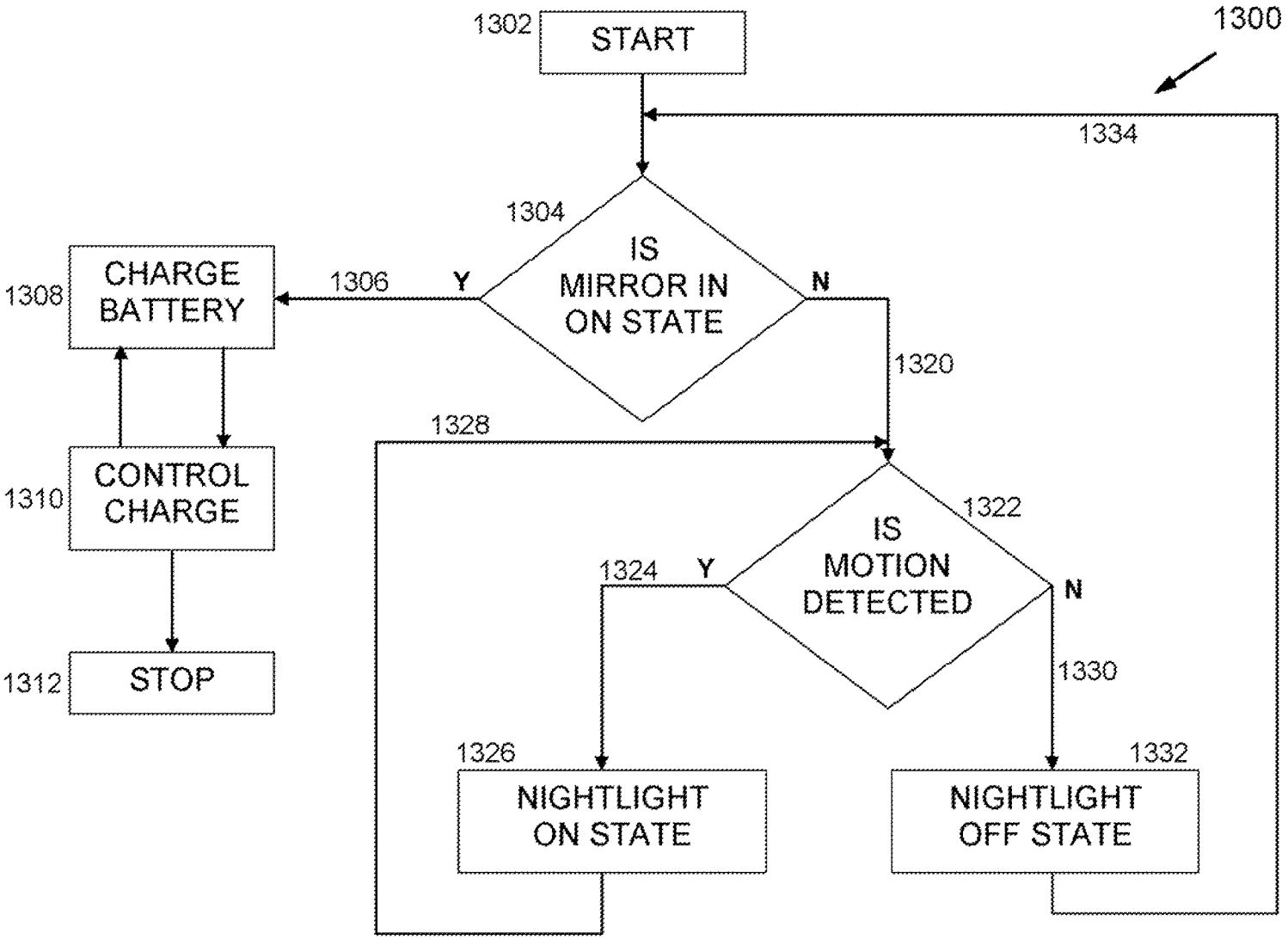
FIG. 13 illustrates a third method of operating a nightlight, according to embodiments of the invention

FIG. 13 illustrates, generally at 1300, a third method of operating a nightlight, according to embodiments of the invention. With reference to FIG. 13, a method starts at a block 1302. At a block 1304, when a lighted mirror is turned to the ON state control transfers via branch 1306 and commences battery charging at a block 1308. Battery charging is controlled by a charge controller 1310. When the charging is finished the charging stops at a block 1312.

If the mirror is turned to the OFF state, then control transfers to a branch 1320 and to the block 1322. Control also transfers to the block 1322 even if charging is not completed in the situation where the user turned the lighted mirror to the OFF state. When the lighted mirror is turned to the OFF state, the nightlight and detection system can power the nightlight when motion is detected within a range of the sensor unit. At a block 1322 a motion detector responds to motion in the vicinity of the lighted mirror. When the measurement from the motion detector exceeds a threshold value (motion is detected), control transfers via 1324 to a block 1326 and the nightlight is turned to the ON state via battery power. Control cycles via 1328 back to the block 1322 where an output of the motion sensor is compared against the threshold value. If the output of the motion detector is above the preset threshold value, then motion is detected and the nightlight remains in the ON state.

At the block 1322, if the output of the motion detector is not above the threshold value then control transfers at 1330 to the block 1332 and the nightlight is moved to the OFF state. The method can cycle in a loop 1334/1304/1322/1330/1332 until motion is detected again or until the user switches the lighted mirror to the ON state. Switching the lighted mirror to the ON state moves the nightlight to the OFF state and transitions the nightlight charging system to the charge state to commence charging the battery if required. In some embodiments, a switch is provided for the nightlight system that disables the system and conserves battery power.

Figure 14:
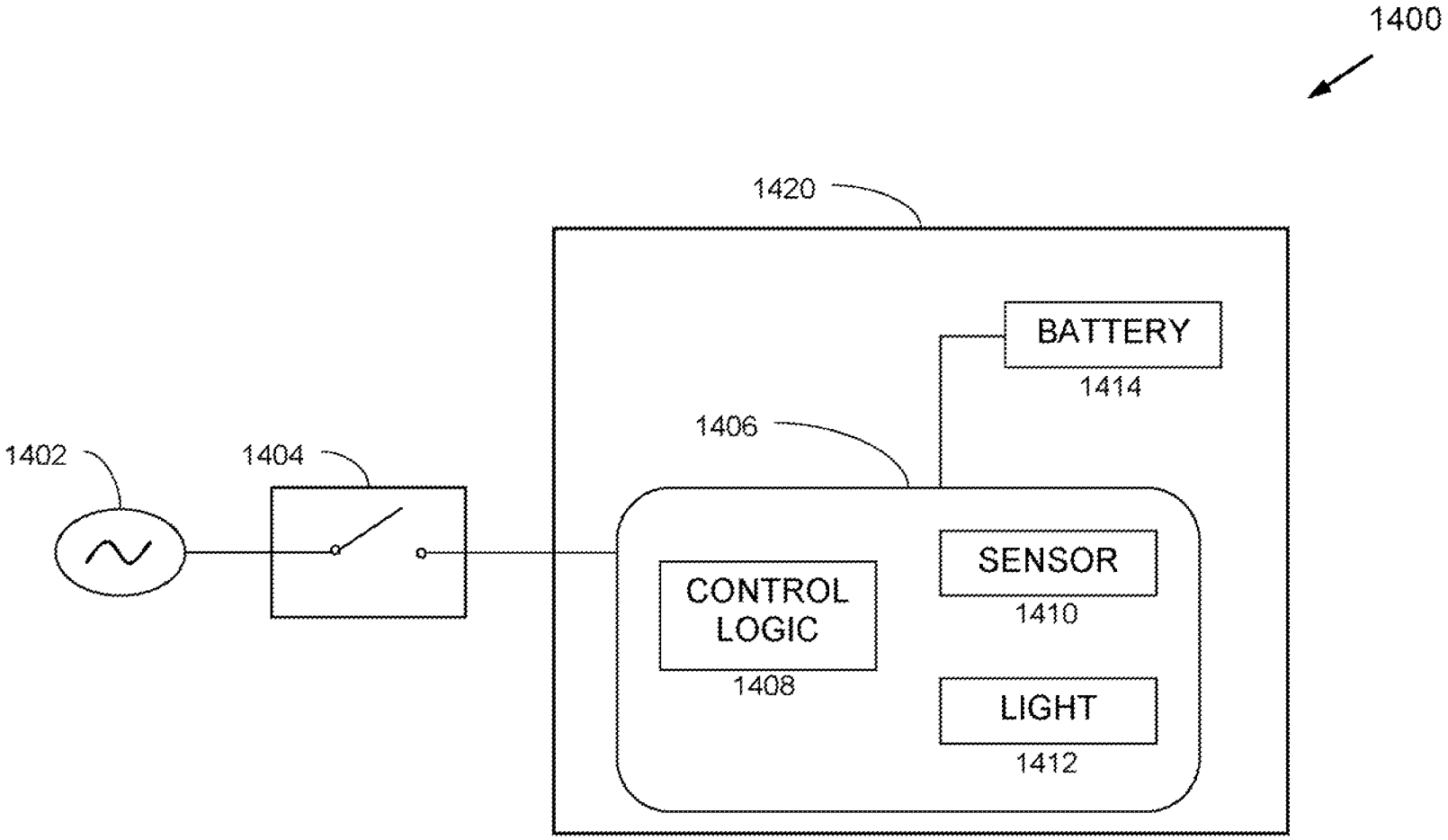
FIG. 14 illustrates a hardware configuration for a nightlight, according to embodiments of the invention.

FIG. 14 illustrates, generally at 1400, a hardware configuration for a nightlight, according to embodiments of the invention. With reverence to FIG. 14, a source of electrical power is indicated at 1402. The source of electrical power 1402 is switched to an ON state or an OFF state at 1404 and is provided to a nightlight system 1406. The nightlight system 1406 incorporates control logic 1408, one or more sensors 1410, and one or more light sources 1412. An onboard source of electrical power is provided at 1414. In some embodiments, the on-board source of electrical power is provided from one or more batteries. The nightlight system is incorporated into a lighted mirror 1420. The control logic 1408 provides battery charging and nightlight operation as described above. Thus, embodiments of a nightlight system for a lighted mirror can be provided on a single circuit board with a single control logic block or the functionality can be distributed as needed to multiple locations within the mirror system.

In various embodiments, a sensor unit, a sensor control circuit(s), a battery charge controller, a battery control circuit board, a nightlight circuit board, and sensor logic circuit(s) (with or without additional components illustrated in the other figures) is implemented in an integrated circuit device, which may include an integrated circuit package containing the integrated circuit. As used in this description of embodiments, the term "integrated circuit" is used synonymously with the term "integrated circuit device." Note also that the term "integrated circuit" is understood to represent at least a part of an integrated circuit but not necessarily what would constitute an entire chip. In some embodiments, the circuit is implemented in a single integrated circuit die. In other embodiments, the circuit is implemented in more than one integrated circuit die of an integrated circuit device which may include a multi-chip package containing the integrated circuit. The embodiments of the present invention are not limited to any particular semiconductor manufacturing technology. Embodiments of the present invention can be implemented using C-MOS, BIPOLAR, Silicon Germanium, or other process technology. The process technologies listed here are provided merely for example and do not limit embodiments of the invention.

In various embodiments, one or more of a sensor unit, a sensor control circuit(s), a battery charge controller, a battery control circuit board, a nightlight circuit board, and sensor logic circuits (with or without additional components illustrated in the other figures) are implemented together in an integrated circuit device, which may include an integrated circuit package containing the integrated circuit. As used in this description of embodiments, the term "integrated circuit" is used synonymously with the term "integrated circuit device." Note also that the term "integrated circuit" is understood to represent at least a part of an integrated circuit but not necessarily what would constitute an entire chip. In some embodiments, the circuit is implemented in a single integrated circuit die. In other embodiments, the circuit is implemented in more than one integrated circuit die of an integrated circuit device which may include a multi-chip package containing the integrated circuit. The embodiments of the present invention are not limited to any particular semiconductor manufacturing technology. Embodiments of the present invention can be implemented using C-MOS, BIPOLAR, Silicon Germanium, or other process technology. The process technologies listed here are provided merely for example and do not limit embodiments of the invention.

Other variations and configurations of embodiments of the invention are realized through variations of one or more of the elements described above. Some of these variations are, but are not limited to, utilizing an organized form of light for the nightlight such as when the light shining through the mirror illuminates an image embedded in the mirror, or causes an image to become visible, that otherwise would be invisible when the nightlight is in the OFF state.

Some examples are, but are not limited to, an image of an animal such as a sheep, an image of an object, such as the moon, a logo, or a phrase such as, "Welcome to our Hotel," etc. Other alternative embodiments are realized when a mirror does not have lighting except the lighting that is provided by the on-board energy storage power system. Other embodiments are realized when the on-board energy storage device is charged by solar energy. Other alternate embodiment of the invention are realized when detection of occupancy in a room is accomplished by a means other than the combination of passive infrared and motion sensors, such as, but not limited to, microwave, radio, or other electromagnetic energy detection and Doppler shift identification, capacitive proximity, active infrared, infrared, infrared range finding, sound wave detection and Doppler shift identification, or changes in pressure, temperature, humidity, or gas, such as volatile organic compounds. In various embodiments, the sensors used to detect ambient light and/or motion can be distributed around the mirror, such as placing one or more sensors in front of the mirror and one or more sensors behind the mirror. In some embodiments, one or more sensors are placed behind and below the mirror as needed for an embodiment. In some embodiments, the mirror glass is prepared for placement of a sensor there behind, such as by removing one or more layers of the mirror construction, such as for example, reflective layers, backing layers, and the like. Thus, the placement of sensors on the mirror is flexible and the descriptions provided herein are provided merely for illustration with no limitation implied thereby.

In some embodiments, a nightlight system is provided as an accessory to an existing lighted mirror. In such cases, the nightlight accessory is an add-on or after market system that is sold separately from the lighted mirror and is added to the lighted mirror through subsequent acts of installation to the existing lighted mirror.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

Some portions of the description may be presented in terms of algorithms and symbolic representations of operations on, for example, data bits within a computer memory. These algorithmic descriptions and representations are the means used by those of ordinary skill in the data processing arts to most effectively convey the substance of their work to others of ordinary skill in the art. An algorithm is here, and generally, conceived to be a self-consistent sequence of acts leading to a desired result. The acts are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

An apparatus for performing the operations herein can implement the present invention. This apparatus may be specially constructed for the required purposes, or it may comprise a general-purpose computer, selectively activated or reconfigured by a computer program stored in the computer. Such a computer program may be stored in a computer readable storage medium, such as, but not limited to, any type of disk including floppy disks, hard disks, optical disks, compact disk-read only memories (CD-ROMs), and magnetic-optical disks, read-only memories (ROMs), random access memories (RAMs), dynamic random access memories (DRAM), electrically programmable read-only memories (EPROM)s, electrically erasable programmable read-only memories (EEPROMs), FLASH memories, magnetic or optical cards, RAID, etc., or any type of media suitable for storing electronic instructions either local to the computer or remote to the computer.

The algorithms and displays presented herein are not inherently related to any particular computer or other apparatus. Various general-purpose systems may be used with programs in accordance with the teachings herein, or it may prove convenient to construct more specialized apparatus to perform the required method. For example, any of the methods according to the present invention can be implemented in hard-wired circuitry, by programming a general-purpose processor, or by any combination of hardware and software. One of ordinary skill in the art will immediately appreciate that the invention can be practiced with computer system configurations other than those described, including hand-held devices, multiprocessor systems, microprocessor-based or programmable consumer electronics, digital signal processing (DSP) devices, set top boxes, network PCs, minicomputers, mainframe computers, and the like. The invention can also be practiced in distributed computing environments where tasks are performed by remote processing devices that are linked through a communications network.

The methods herein may be implemented using computer software. If written in a programming language conforming to a recognized standard, sequences of instructions designed to implement the methods can be compiled for execution on a variety of hardware platforms and for interface to a variety of operating systems. In addition, the present invention is not described with reference to any particular programming language. It will be appreciated that a variety of programming languages may be used to implement the teachings of the invention as described herein. Furthermore, it is common in the art to speak of software, in one form or another (e.g., program, procedure, application, driver, . . . ), as taking an action or causing a result. Such expressions are merely a shorthand way of saying that execution of the software by a computer causes the processor of the computer to perform an action or produce a result.

It is to be understood that various terms and techniques are used by those knowledgeable in the art to describe communications, protocols, applications, implementations, mechanisms, etc. One such technique is the description of an implementation of a technique in terms of an algorithm or mathematical expression. That is, while the technique may be, for example, implemented as executing code on a computer, the expression of that technique may be more aptly and succinctly conveyed and communicated as a formula, algorithm, or mathematical expression. Thus, one of ordinary skill in the art would recognize a block denoting A+B=C as an additive function whose implementation in hardware and/or software would take two inputs (A and B) and produce a summation output (C). Thus, the use of formula, algorithm, or mathematical expression as descriptions is to be understood as having a physical embodiment in at least hardware and/or software (such as a computer system in which the techniques of the present invention may be practiced as well as implemented as an embodiment).

Non-transitory machine-readable media is understood to include any mechanism for storing information in a form readable by a machine (e.g., a computer). For example, a machine-readable medium, synonymously referred to as a computer-readable medium, includes read only memory (ROM); random access memory (RAM); magnetic disk storage media; optical storage media; flash memory devices; except electrical, optical, acoustical or other forms of transmitting information via propagated signals (e.g., carrier waves, infrared signals, digital signals, etc.); etc.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus to provide a source of light, comprising:
- a lighted mirror, the lighted mirror is configured for installation within a building;
- a single electrical power circuit, the single electrical power circuit to provide a source of electrical power to the lighted mirror from the building, the single electrical power circuit is either in an ON state or an OFF state, the lighted mirror further comprising:
  - a nightlight system, the nightlight system comprising:
    - a battery, the battery is electrically connected to charge when the single electrical circuit is in the ON state;
    - a first sensor, the first sensor is configured to receive electrical power from the battery and to measure a first value for a first parameter from an area proximate to the lighted mirror;
    - a nightlight, the nightlight is electrically connected to receive electrical power from the battery, the nightlight has an ON state and an OFF state; and
    - control logic, the control logic to receive the first value and to turn the nightlight to the ON state when the first value is above a first threshold, thereby providing a source of light from the nightlight, when the single electrical power circuit is in the ON state electrical power is inhibited from the nightlight placing the nightlight in the OFF state.

2. The apparatus of claim 1, wherein the first sensor is a photosensor, the first parameter is ambient light and the first value is a measurement representative of ambient light.

3. The apparatus of claim 2, the control logic to place the nightlight in the ON state when the first value is below a first threshold.

4. The apparatus of claim 2 further comprising:
- a second sensor, the second sensor is configured to receive electrical power from the battery and to measure a second value for a second parameter from an area proximate to the lighted mirror.

5. The apparatus of claim 4, wherein the second sensor is a motion sensor, the second parameter is motion and the second value is a measurement representative of motion, the control logic to place the nightlight in the ON state when the first value is below a first threshold and the second value is above a second threshold.

6. The apparatus of claim 1, the first sensor is a motion sensor, the first parameter is motion and the first value is a measurement representative of motion, the control logic to place the nightlight in the ON state when the first value is above a first threshold.

7. The apparatus of claim 5, wherein the nightlight remains in the ON state for a time interval after it is switched to the ON state, if a third value for the second parameter falls below the second threshold after expiration of the time interval then the control logic switches the nightlight to the OFF state.

8. The apparatus of claim 7, wherein the time interval is one or more minutes.

9. The apparatus of claim 7, wherein the time interval is less than one minute.

10. An apparatus to provide a source of light, comprising:
- a lighted mirror, the lighted mirror is configured for installation within a building;
- a single electrical power circuit, the single electrical power circuit to provide a source of electrical power to the lighted mirror from the building, the single electrical power circuit is either in an ON state or an OFF state, the lighted mirror further comprising:
  - a nightlight system, the nightlight system comprising:
    - a battery, the battery is electrically connected to charge when the single electrical circuit is in the ON state;
    - a sensor, the sensor is configured to receive electrical power from the battery and to measure ambient light and motion, wherein motion is detected within an area proximate to the lighted mirror;
    - a nightlight, the nightlight to receive electrical power from the battery, the nightlight has an ON state and an OFF state; and
    - control logic, the control logic to receive a first signal responsive to a measurement of ambient light and a second signal responsive to motion within a range of the lighted mirror, the control logic to turn the nightlight to the ON state when the first signal is at or below a first threshold and the second signal is at or above a second threshold, thereby providing a source of light from the nightlight.

11. The apparatus of claim 10, wherein the control logic performs an inhibition of the nightlight when the single electrical power circuit is in the ON state, the inhibition places the nightlight in the OFF state.

12. The apparatus of claim 11, wherein the inhibition changes a configuration of the electrical circuit that provides power to the nightlight.

13. A method to operate a nightlight in a lighted mirror, comprising:

monitoring whether a first electrical power circuit is in an OFF state, when the first electrical power circuit is in the OFF state, then the method further comprising:

receiving a first signal from a first sensor of a sensor unit;

comparing the first signal to a first threshold value;

placing the nightlight in an ON state based on the comparing; and charging a battery when the first electrical power circuit is in an ON state.

14. The method of claim 13, further comprising:

providing electrical power to the nightlight from the battery when the first electrical power circuit is in the OFF state.

15. The method of claim 13, when the first electrical power circuit is in the OFF state, then the method further comprising:

receiving a second signal from a second sensor of the sensor unit, the first signal is responsive to ambient light and the second signal is responsive to motion.

16. A nightlight accessory for a lighted mirror, wherein the lighted mirror is wired to a single electrical power circuit, the night light accessory comprising:

a connection for an electrical power circuit, the single electrical power circuit is connected to the connection when the nightlight accessory is installed in the lighted mirror;

a battery, the battery is electrically connected to charge when the single electrical circuit is in an ON state;

a sensor unit, the sensor unit is configured to receive electrical power from the battery and to measure ambient light and motion, wherein motion is detected within an area proximate to the lighted mirror;

a nightlight, the nightlight to receive electrical power from the battery, the nightlight has an ON state and an OFF state; and control logic, the control logic to receive a first signal responsive to a measurement of ambient light and a second signal responsive to motion within a range of the lighted mirror, when the single electrical power circuit is in an OFF state the control logic to turn the nightlight to the ON state when the first signal is at or below a first threshold and the second signal is at or above a second threshold, thereby providing light from the nightlight.

17. The apparatus of claim 16, wherein the nightlight is made with light emitting diode (LED) technology.

18. The apparatus of claim 16, wherein the control logic performs an inhibition of the nightlight when the electrical power circuit is in the ON state.

19. The apparatus of claim 18, wherein the inhibition changes a configuration of an electrical circuit that provides power to the nightlight which places the nightlight in the OFF state.

20. The apparatus of claim 1, when the nightlight is in the ON state, light radiates from the lighted mirror in the form of an image embedded in the lighted mirror, when the nightlight is in the OFF state the image is invisible.

21. The apparatus of claim 1, wherein the first sensor is placed near the lighted mirror.

22. The apparatus of claim 4, wherein the second sensor is placed near the lighted mirror.

23. The apparatus of claim 22, wherein the first sensor is placed near the lighted mirror.

24. The apparatus of claim 10, when the nightlight is in the ON state, light radiates from the lighted mirror in the form of an image embedded in the lighted mirror, when the nightlight is in the OFF state the image is invisible.

25. The apparatus of claim 10, wherein the sensor is placed near the lighted mirror.

26. The method of claim 13, when the nightlight is in the ON state, light radiates from the lighted mirror in the form of an image embedded in the lighted mirror, when the nightlight is in an OFF state the image is invisible.

27. The method of claim 13, wherein the first sensor is placed near the lighted mirror.

28. The method of claim 15, wherein the second sensor is placed near the lighted mirror.

29. The method of claim 28, wherein the first sensor is placed near the lighted mirror.

30. The apparatus of claim 16, when the nightlight is in the ON state, light radiates from the lighted mirror in the form of an image embedded in the lighted mirror, when the nightlight is in the OFF state the image is invisible.

31. The apparatus of claim 16, wherein the sensor unit is placed near the lighted mirror.

* * * * *